United States Patent [19]

Limmergard

[11] 4,336,906

[45] Jun. 29, 1982

[54] ARRANGEMENT BY CROSSINGS BETWEEN ROADS AND RAILWAYS

[75] Inventor: Sten Limmergard, Humlaryd, Sweden

[73] Assignee: A-Betong AB, Sweden

[21] Appl. No.: 105,629

[22] Filed: Dec. 20, 1979

[30] Foreign Application Priority Data

Dec. 20, 1978 [SE] Sweden ..... 7813091

[51] Int. Cl.[3] ..... E01B 21/02

[52] U.S. Cl. ..... 238/8

[58] Field of Search ..... 238/2, 3, 5, 7, 8, 9

[56] References Cited

U.S. PATENT DOCUMENTS 3,773,255 11/1973 Schoulties ..... 238/2

4,010,896 3/1977 Stockton ..... 238/2

*Primary Examiner*—Richard A. Bertsch

[57] ABSTRACT

The present invention relates to an arrangement for crossings between a road and railway, where the road structure is interrupted between two edges, between which is positioned at least one railroad track, the arrangement comprising two rails supported by a row of sleepers arranged substantially perpendicular to the rails, said sleepers resting on a foundation, outer slabs being deposited in the area between the rails and the respective edges of the road structure, and a center slab, preferably divided up into sections in the longitudinal direction of the track and positioned between the rails forming the railroad track, which slabs are provided with their top surfaces level with the top surfaces of the rails and the top surface of the road structure, and elongated supporting elements provided to extend along said edges of the road structure. The elongated supporting elements comprise in combination a bottom surface provided to rest on the foundation, a first side edge which is provided to face the road structure, forming a support for the same, a first upper surface connected to said side edge, a positioned second upper surface positioned at a distance from the first upper surface which substantially is level with the first upper surface, between the both upper surfaces and extending along the supporting element, a groove open in the upper surfaces and provided to form a water outflow, a second side edge opposite to the first side edge, forming a support for the outer edge of the respective outer slab, so that the elongated supporting element forms a support for the road structure, a base surface level with the road and the outer slab, a support for the outer slab and a water outflow for water preferably from the road.

5 Claims, 5 Drawing Figures

ARRANGEMENT BY CROSSINGS BETWEEN ROADS AND RAILWAYS

Figure 1:
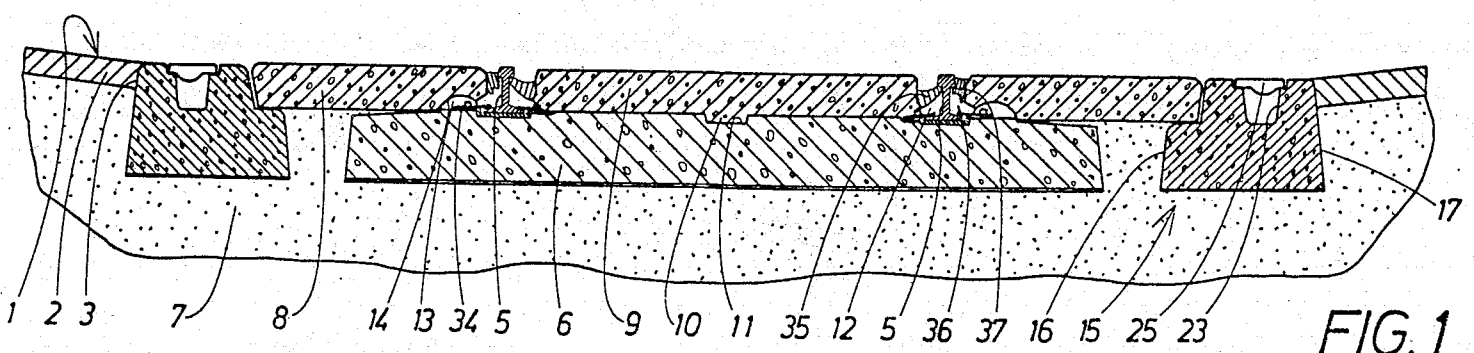

The present invention relates to an arrangement for crossings between roads and railways, where the road structure is interrupted between two edges, between which is positioned at least one railroad track comprising two rails supported by a row of sleepers arranged substantially perpendicular to the rails, said sleepers resting on a foundation, outer slabs being deposited in the area between the rails and the respective edges of the road structure, and a center slab, preferably divided up to sections in the longitudinal direction of the track and being deposited between the rails forming the railroad track, which slabs are intended with their top surfaces to be level with the top surfaces of the rails and the top surfaces of the road structure. The arrangement includes stripshaped elements between the edges of the road structure and the respective outer slabs.

In crossing between roads and railroads it is desirable that the respective vehicle shall have an unobstructed crossing on the road as well as on the railroad. As no obstacles can be permitted for the rail guided vehicle, interruptions of the paving of the road are necessary in order to permit the passage of the rails and provide accomodation for the wheel flanges running along the inwards facing sides of said rails. In order to make the interruptions of the paving as insignificant as possible the paving in the crossing has to be kept as closely as possible level with the rails and at the same time the accomodation space provided for the wheel flanges has to be as small as possible, so that it will be as insignificant as possible. The first mentioned aim can be difficult to obtain, as movements because of sinking in the ground are different in the paving compared with the rail bed. The other aim in a certain degree is contrary to the demand for good trafficability for the railroad vehicles. Thus a narrow groove for the flanges offers good trafficability and comfortable driving for road vehicles, but the railroad traffic requires that the groove be so wide that the necessary free space for the wheel flanges is obtained.

The arrangements in connection with crossings between roads and railways according to the prior art employ small elements as a great number of equal concrete slabs. This results in the drawback that said small elements easily will be displaced from each other and will form an uneven paving as they are carried by a bed of macadam. Further the manufacture as well as the application of such small elements means a considerable lot of manual work, which is not rational and raises the costs.

However, also larger elements in the form of slabs have been introduced which elements have been dimensioned to suite the surface present which has to be covered i.e. the surface between the rails in a railroad and the surface between the rails and the paving of the road. Certain drawbacks are connected with said arrangements according to the prior art for use according to functions as drainage and the carrying of the slabs outside of the rails.

The present invention has as its object to provide an improvement of an arrangement of the type which comprises few large elements and by which arrangement the drawbacks mentioned according to drainage and carrying of the slabs are eliminated.

The object of the invention is obtained by providing the elongated supporting elements with a bottom surface provided to rest on the foundation, a first side edge which is provided to face the road structure, forming a support for the same, a first upper surface connected to said side edge, a second upper surface positioned at a distance from the first upper surface, which substantially is level with the first upper surface, between the both upper surfaces and extending along the supporting element, a groove open in the upper surfaces and provided to form a water outflow, a second side opposite to the first side edge, forming a support for the outer edge of the respective outer slab.

Figure 2:
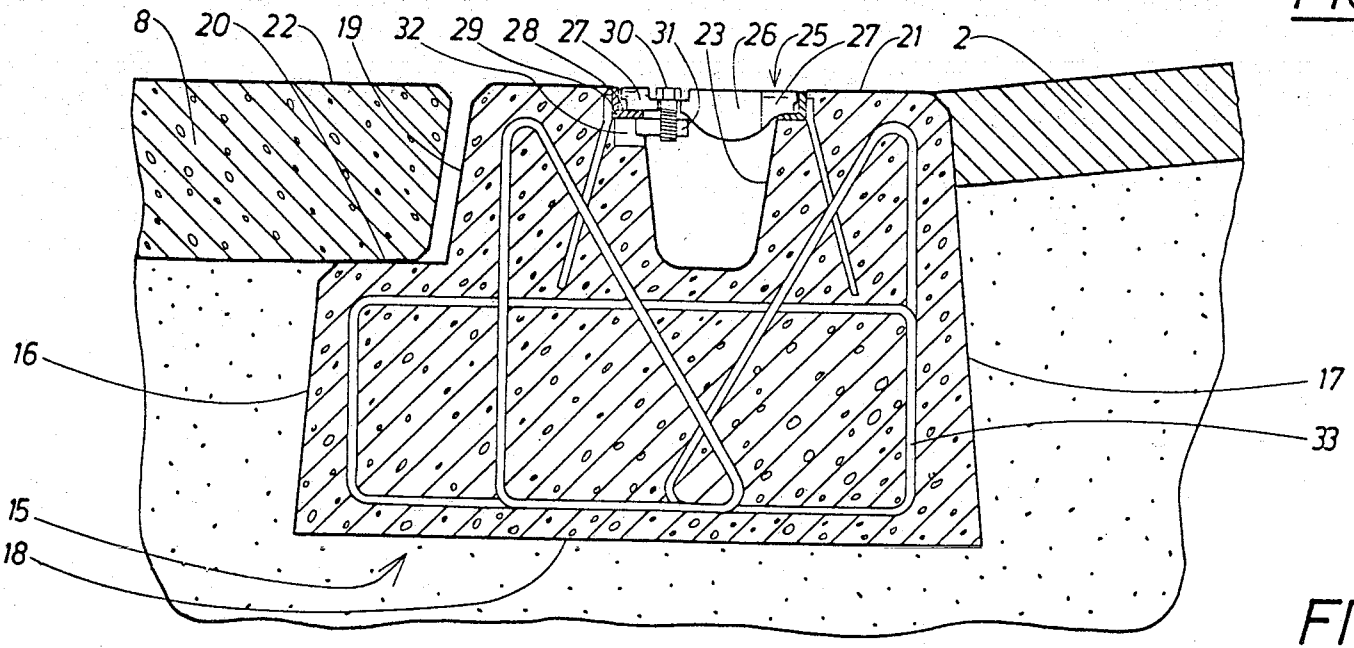
Figure 3:
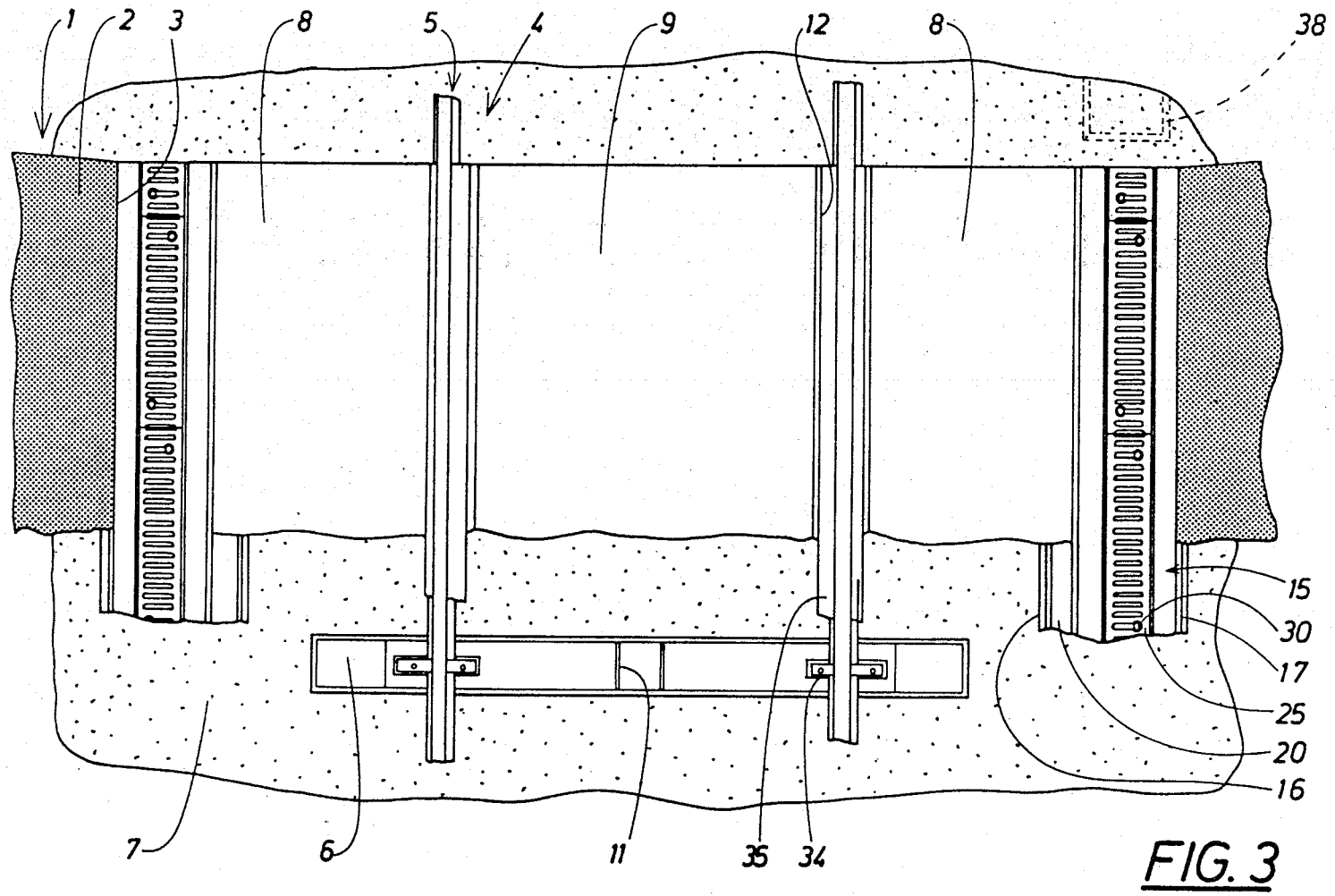
Figures 4, 5:
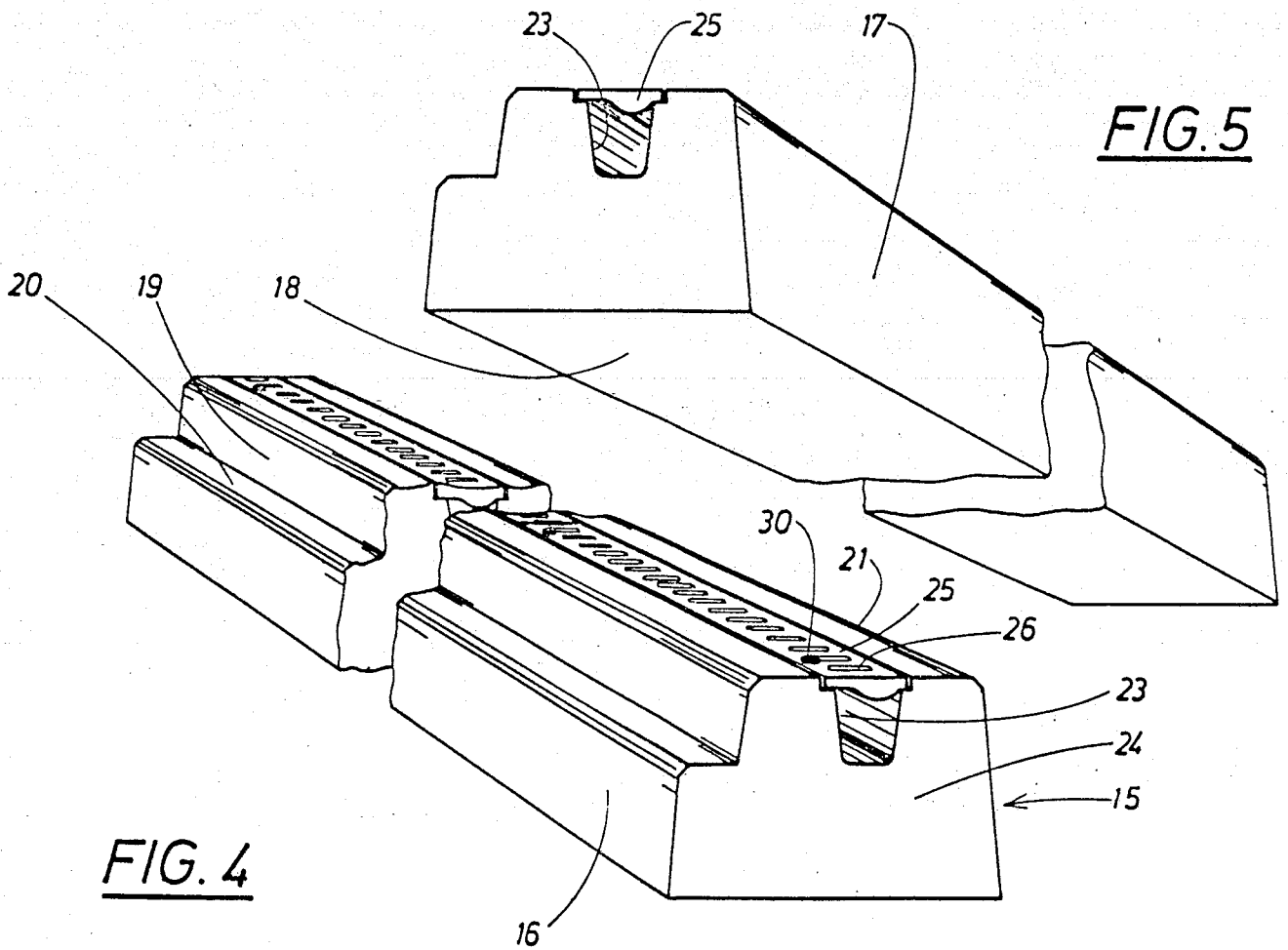

An embodiment of the invention is described in the following reference being made to the accompanying drawings, in which FIG. 1 shows a cross-section through the arrangement as seen in the longitudinal direction of the road, FIG. 2 is a view of a portion of the cross-section of FIG. 1 on an enlarged scale, FIG. 3 is a top view of the crossing, FIGS. 4 and 5 are perspective views of an elongated supporting element used in connection with the invention.

According to FIGS. 1 and 3 a road structure 2, here illustrated with a paving 2 of for example bitumen, has a clearing with edges 3 for the passage of a crossing railway track 4. The railway track 4 is shown as a single-track with two rails 5, which are supported by concrete sleepers 6. The paving 2 of the road structure 1 as well as the sleepers 6 of the track 4 are supported by a frost buffering foundation layer, a so called railway ballast 7.

In order to connect the parts of the road section 1, three concrete slab units extend in the longitudinal direction of the road between the edges 3, two of which, hereinafter called the outer slabs 8, extends along the outside of the two rails 5 of the track and one slab between said rails, in the following mentioned as the center slab 9. In the following the slabs 8 and 9 respectively are mentioned as a single slab unit, but they can also comprise a row of slabs in the longitudinal direction of the railway track. They are then divided up into sections because of technical reasons related to their manufacture, transportation and strength, and to the curving of railroad if any, thus forming rows, with the number of slabs adjusted according to the width of the road structure 1.

However, it is an essential feature of the invention that the slabs have a considerable size, and as mentioned above, be so wide in the cross direction of the railway track that they have an unbroken extension between the edge of the road structure and the rail and between the rails respectively, but also in the longitudinal direction they are preferably given such a dimension that they for example correspond to one half of the intended width for the road structure and in connection with narrow roads even to the whole width. However, when the width of the road is of great proportions the slabs can be divided up into two or more sections, as mentioned above, each one, however, being of considerable length, preferably in the order of magnitude of 6 meters.

The center slab 9 is arranged to be supported by the sleepers 6 and to be held in place by the latter ones by means of a locking arrangement comprising a ledge 10 on the slab 9 and a groove 11 in the sleepers. The ledge 10 and the groove 11 with respect to position and fit are arranged in such a manner that the slab 9 will occupy a symmetric position between the rails 5 in such a way that two groove-like spaces 12 well defined as to their width will be formed between the edges of the slab 9 and the rails 5. The outer slabs 8 are arranged at their inner sides facing the rails 5 to be supported by the sleepers 6 in a locking arrangement, which is formed by a ledge 13 of cylindric surface located on the sleepers and corresponding to a cylindrical recess 14 along the inner edge of the outer slabs 8. A number of clamping means 25 and 26 of spring steel are provided to hold the rail, said clamping means being fastened to the sleepers by means of expanding bolts 27 or similar. In order to satisfy the demand for a free accessability for the wheel flanges to the space 12 and at the same time avoid the falling down of undesired material in the same, it is provided with a resilient sealing strip 35, preferably made of rubber.

Between the rail 5 and the outer slabs is provided a space 36 so that the outer slab 8 is given a free play for sinking movements by the thrusts and vibrations, which arise in traffic situations, and the movements due to differences of thermal expansion and contraction arising as a result of the rail being made of steel and the slab of concrete. However, it is desirable that also the space 36 is sealed off, so that dirt will not accumulate in the same. Such accumulation could in fact lead to the different parts being relative to each other as a result of stresses caused by frost. In order to seal off the space 36, a sealing strip 37 of rubber is attached to each respective slab 8 by means of expanding bolts 42. However, the sealing strip 37 does not need to perform any movement aside and therefore exhibit has the shape of an element just squeezed in place between the rail and the sides of the slab.

According to the invention the arrangement includes two supporting elements 15 in the shape of ledges made of reinforced concrete, which stretch along the outer edges of the outer slabs 8. The shape of the supporting elements 15 is best shown in FIGS. 2, 4 and 5. Each element 15 is provided to form a support for the slabs 8 at its one longitudinal edge 16 and to form a border support at its opposite longitudinal edge portion 17 for the paving 2 of the road. The supporting elements 15 comprise a plane bottom surface 18 the width of which is sufficient to form a support for the element resting at the ballast 7 forming a foundation. The first longitudinal edge portion 16 is provided with a longitudinal recess 19 forming a supporting surface 20 with a width adapted to form secure support for the outer edge of the outer slabs 8. In order to give a good stability to the supporting elements 15 the longitudinal edge portions 16, 17 slope inwards and upwards so that the elements have a width decreasing upwards. The supporting elements 15 are shaped with a substantially plane upper side 21, which in the mounted position of the elements 15 is intended to be positioned at the same level as the paving 2 of the road where it connects to the elements 15 and also with be level to the upper side 22 of the respective outer slabs.

The supporting elements 15 are according to the invention provided with a water outflow in the shape of a groove 23 opening upwards. This groove stretches from end to end of the supporting element and debouches in both of the end surfaces 24 of the respective elements. The groove is at its opening covered by a grill 25 the upper side of which substantially is at the same level as the upper side 21 of the supporting elements. The grill is provided with a multiple of openings 26 in the form of slots which in the shown embodiment are directed in the longitudinal direction of the road. The grill 25 rests with its both longitudinal edge portions 27 in recesses which form countersunk supporting borders 25 in the upper part of the groove adjacent to the upper surface 21 of the element. The supporting borders 25 are reinforced in the shown embodiment by means of angle irons 29. The grill 25 is fastened by means of fastening elements in the form of screws 30 which are countersunk in the grill and stretch through enlarged portions in some of the openings 26 and which are each threaded in an anchor element 31 which is positioned at the underside of the grill and extends in under the adjacent angle iron 29 in a recess 32 provided for each of the anchor elements. The grill 25 is thus pressed against the angle irons 29. For practical reasons the grill can be divided in several separate sections into a row stretching along the entire length of the supporting element. As is evident from FIG. 2 the supporting element 15 is reinforced by means of steel bars 33 which can be arranged in the way shown in the figure.

The groove 23 thus functions as a water outflow in a very efficient way draining off water as rainwater which flows on the road and collects at the crossing especially if this is placed in a hollow. This draining off of the water is of great advantage at the railroad crossings of the shown type as the spaces between its parts are sealed against each other resulting in a low water drainage in the crossing. In FIG. 3 there is by means of a broken line shown a draining pipe 38 for drain off of the water flowing from the crossing. It is from the view of traffic security important that a road is as free as possible from pools of water during all the seasons.

In practice, movements of parts cannot be avoided in the crossing. Such movements arise because of sinking phenomena aggravated by the road and rail traffic passing the crossing and because of movements caused by frost. On the other hand the outer edges are supported by the supporting elements 15 embedded in the paving 2. This means that the slabs 8 at their edges bordering on the rail always will be connected flush with the top side of the same at the same time, as they is level with the paving 2 irrespective of any differences in measure of the movements of the paving and sleepers, which is a quite common phenomenon. In connection with such unequal movements the slab 8 can pivot round the cylindrical surfaces 13, 14 so that any movements, which could cause breakages, will not arise at the same time as the bottom surface of the slab 8 at its outer edge can perform a wobbling movement against the surface 20 of the supporting element 15.

When a crossing shall be constructed, first the track will be applied and in connection with the application of the road structure, the supporting elements 15 are put in place. The slabs 8 and 9 are thereafter by means of a hoist lowered down on the foundations shaped by the sleepers 6 and the supporting elements 15. Any adjustment is not necessary because of the connecting arrangements formed by the projections 10 and 13. As mentioned, the length of the slabs 8, 9 is so great that the whole width of the road structure is covered by one or a few slabs in the longitudinal direction of the railway. These large slabs moreover make possible their manufacturing by rational methods in machines with a minimum of manual work. The supporting elements 15 are forming a determined termination for the paving which make the application of the paving easier and make connections without any step between the paving 2 of the road and the parts of the crossing possible.

Thus, the objects mentioned in the preamble have been reached by means of an arrangement according to the invention, and a crossing has been attained, in which high demands for convenience and security in crossing are satisfied, while the least possible maintenance work is required. Within the scope of the following claims the means according to the invention can be adjusted to different desired objects and conditions. Thus, the parts can be adapted for crossings, which do not occur a right angle. The invention is neither dependant on the materials mentioned, nor on the type of rail clamping shown. The invention is not restricted to the shown proportions of the supporting elements. The grill can be integrated in the supporting elements for example by forming slots in the concrete in the upper side of the supporting elements.

What is claimed is:

1. Arrangement for crossings between a road and a railway, where the road structure has two edges, between which is positioned at least one railroad track, the arrangement comprising two rails supported by a row of sleepers arranged substantially perpendicular to the rails, said sleepers resting on a foundation, outer slabs deposited in the area between the rails and the respective edges of the road structure, and a center slab, preferably divided up into sections in the longitudinal direction of the track and positioned between the rails forming the railroad track, said slabs having their top surfaces level with the top surfaces of the rails and the top surface of the road structure, and elongated supporting elements extending along said edges of the road structure each comprising in combination a bottom surface resting on the foundation, a first side edge facing the road structure and forming a support for the same, a first upper surface connected to said first side edge, a second upper surface positioned at a distance from the first upper surface, which is substantially level with the first upper surface, a groove between the first and second upper surfaces and extending along the supporting element, said groove being open in the upper surfaces and forming a water outflow, and a second side edge opposite to the first side edge forming a support for the outer edge of the respective outer slab, so that the elongated supporting element forms a support for the road structure, a base surface level with the road and the outer slab, a support for the outer slab and a water outflow for water preferably from the road.

2. Arrangement according to claim 1, in which the groove for water outflow is provided with a grill through which the water can flow, the upper side of which connects to the upper surfaces of the supporting element.

3. Arrangement according to claim 2, in which the groove at it sides is provided with countersunk edge portions forming supports for the grill.

4. Arrangement according to claim 3, in which the grill is provided with a number of clamping means provided to be pressed against the underside of the grill by means of fastening elements, preferably screws extending through the grill, so that the grill will be attached to the supporting elements.

5. Arrangement according to claim 4, in which the countersunk edge portions are provided with a recess for each of said clamping elements.

* * * * *